United States Patent [19]

Sakai et al.

[11] 4,217,204

[45] Aug. 12, 1980

[54] PROCESS FOR CRACKING HYDROCARBONS UTILIZING A MIST OF MOLTEN SALT IN THE REACTION ZONE

[75] Inventors: Atsushi Sakai, Otake; Fumiaki Yamaguchi; Tetsu Kawazoe, both of Iwakuni; Hayato Yonemori, Koganei; Yoshio Machida, Iwakuni, all of Japan

[73] Assignees: Mitsui Engineering and Shipbuilding Co., Ltd.; Mitsui Petrochemical Industries Ltd., both of Tokyo, Japan

[21] Appl. No.: 10,131

[22] Filed: Feb. 7, 1979

Related U.S. Application Data

[63] Continuation-in-part of Ser. No. 974,048, Dec. 28, 1978, abandoned, which is a continuation of Ser. No. 824,171, Aug. 12, 1977, abandoned.

[30] Foreign Application Priority Data

Feb. 13, 1978 [JP] Japan ..... 53-14127

[51] Int. Cl.[2] ..... C10G 9/34

[52] U.S. Cl. ..... 208/125; 585/634; 585/648; 585/912

[58] Field of Search ..... 260/683 R; 208/125, 208/130, 48 Q, 128

[56] References Cited

U.S. PATENT DOCUMENTS

| | | | |
|---|---|---|---|
| 1,948,345 | 2/1934 | Garofalo | 208/125 |
| 2,893,941 | 7/1959 | Kohfeldt et al. | 208/48 Q |

FOREIGN PATENT DOCUMENTS

| | | | |
|---|---|---|---|
| 891271 | 3/1962 | United Kingdom | 260/683 R |
| 1357495 | 6/1974 | United Kingdom | 260/683 R |
| 1372706 | 11/1974 | United Kingdom | 260/683 R |

*Primary Examiner*—George Crasanakis

[57] ABSTRACT

Hydrocarbons are cracked in the presence of a mist of molten salt containing of basic compounds of alkali and alkaline earth metals and mixtures thereof, the amount of the molten salt to hydrocarbon being, by weight, from 0.01:1 to 10:1 followed by quenching at a temperature not lower than the melting point of the molten salt, and separating the cracked gas from the molten salt.

7 Claims, 3 Drawing Figures

PROCESS FOR CRACKING HYDROCARBONS UTILIZING A MIST OF MOLTEN SALT IN THE REACTION ZONE

RELATED APPLICATIONS

This application is a continuation in part of copending application Ser. No. 974,048, filed Dec. 28, 1978 and now abandoned, which is in turn a continuation of application Ser. No. 824,171 filed Aug. 12, 1977 and now abandoned.

BACKGROUND OF THE INVENTION

1. Field of the Invention

This invention relates to a process for cracking heavy liquid hydrocarbons such as, for example, crude oil, heavy oil, bottom residue of vacuum distillation and the like which contain varying amounts of carbon residues.

2. Description of the Prior Art

Various processes are known for cracking to as high as asphalt to produce hydrogen, ethylene, propylene, butadiene, benzene, toluene, xylene and the like at high temperatures.

In commercial processes for producing petrochemical raw materials, there are often used light hydrocarbons such as natural gas, refinery off gas, naphtha, and light oil produced by atmospheric pressure distillation, but high-boiling oils such as crude oil, light oil from reduced pressure distillation and the like are used only to a limited extent.

The main reason is that the heavier the raw material, the easier carbon and tar-like materials are formed as by-products upon cracking. The resulting by-product attach to and deposit in the cracking apparatus and quenching devices for the cracked gas and therefore extended running periods such as 1000 hours or more become impossible.

A number of processes have been proposed for suppressing the formation of carbon and tar-like materials, and for preventing them from attaching to and depositing in the apparatus, but these conventional processes have various drawbacks such as high investment requirements, increase in necessary heat energy requirements which may be provided such as steam and the like, and decrease in the energy recovered from the process. No method of eliminating these drawbacks and providing for continuous operation utilizing high boiling oils has yet been discovered.

Processes for cracking hydrocarbons in the presence of molten salts or molten metals are known. In these prior art processes, the molten salt is usually used as a heat transfer medium. Hydrocarbons such as high-boiling oils are blown into a molten salt to receive the quantity of heat necessary for cracking at an elevated temperature. According to this type of cracking process, the sum of the sensible heat required for heating crude oil or a combination of crude oil and a diluting agent such steam up to a cracking temperature, heat of vaporization of crude oil and decomposition reaction heat of crude oil amounts to about 1000 Kcal. per Kg. of crude oil.

The quantity of molten salt circulating as a heat transfer medium amounts to many times the weight of crude oil. Therefore, the quantity of the molten salt in the apparatus is very large. From the view point of safety, it is not desirable to keep such a large quantity of a molten salt at high temperature in an oil cracking plant where large quantities of combustible and inflammable materials are always present.

In addition, circulating such a large quantity of a molten salt renders design of apparatus and its operation very difficult. Additionally, large amounts of energy are needed to circulate large amounts of molten salt.

No completely satisfactory method for avoiding these disadvantages has yet been discovered, although several have been proposed.

Among such attempted processes, those disclosed in U.S. Pat. Nos. 3,192,018 and 3,210,268 are relatively similar to the present invention. However, these processes still suffer from the above-mentioned disadvantages from a commercial point of view. For example, U.S. Pat. No. 3,192,018 discloses alkali metal chlorides as the molten salt. The salt passes together with crude oil through a reactor at a high velocity. In this process a large quantity of a molten salt must be used as a heat transfer medium to impart the required quantity of heat. One result is that none of the heat transfer medium can used in a mist form. Instead liquid drops of a fairly large drop size such as about 1000 microns in size are employed.

The processes mentioned above can prevent carbon from depositing on the reaction vessel wall, but the resulting carbon particles are of such a large size that they can not be removed by the water gas reaction under the cracking conditions. Therefore, the molten salt can not be reused unless the carbon is removed by combustion of carbon or by other treatment.

Japanese Patent Publication Nos. 19244/1972 and 8791/1975 disclose processes for preventing carbon from depositing in a quenching device by employing molten metals or molten heavy metal salts. In particular, the former procedure is quite similar to the present invention, but utilizes a molten metal as a flowing entrainment medium. The particle size of the molten metal is large. Therefore, it has drawbacks similar to those of U.S. Pat. No. 3,192,018. Further the metals and their compounds can not be subjected to the water gas reaction so that other treatments are necessary to remove carbon.

SUMMARY OF THE INVENTION

An object of the present invention is to provide a process for cracking hydrocarbons which is free from deposition of carbon and tar-like material in the heat decomposition device and the quenching device.

Another object of the present invention is to provide a process for cracking hydrocarbons while utilizing a minimum amount of a molten salt for preventing undesirable deposition of carbon and tar-like materials in the cracking apparatus, the heat decomposition device, or the quenching device.

A further object of the present invention is to provide a process for cracking hydrocarbons in which the molten salt need not be separately purified but can be retained in the reaction system.

A still further object of the present invention is to provide a process for cracking hydrocarbons in which carbon can be eliminated by water the gas reaction with diluting steam.

Still another object of the present invention is to provide a process for cracking hydrocarbons which needs only a small quantity of heat and can be conducted in a compact apparatus.

A still further object of the present invention is to provide a process for cracking hydrocarbons which uses only a small amount of a heat transfer medium and is free from danger of fire.

A still further object of the present invention is to provide a process for cracking hydrocarbons which is free from clogging near the feed inlet of heavy liquid hydrocarbons.

According to the present invention, there is provided a process for cracking hydrocarbons comprising cracking the hydrocarbons in the presence of a mist of molten salt containing a member selected from the group consisting of basic compounds of alkali metals, basic compounds of alkali and alkaline earth metals and mixtures thereof, the amount of the molten salt by weight of the hydrocarbons being from 0.01:1 to 10:1, introducing the resulting cracked gas containing most of the molten salt into a means for quenching at a temperature not lower than the melting point of the molten salt, and then separating the cracked gas and the molten salt from each other.

DESCRIPTION OF PREFERRED EMBODIMENTS

Molten salts used in the present invention are selected from basic compounds of alkali metals, basic compounds of alkaline earth metals and mixtures thereof.

Representative basic compounds for molten salts are hydroxides of metals such as sodium hydroxide, potassium hydroxide, lithium hydroxide, barium hydroxide and the like; carbonates of metals such as sodium carbonate, potassium carbonate, lithium carbonate and the like; double salts such as $KNaCO_3$, $KMgH(CO_3)_2$ and the like; mixtures of basic compounds such as a mixture of 50 molar % sodium hydroxide and 50 molar % potassium hydroxide, a mixture of 50 molar % sodium carbonate and 50 molar % potassium carbonate, a mixture of 20 molar % barium carbonate, 40 molar % calcium carbonate, and 40 molar % lithium carbonate, and the like. It is preferable to use a mixture of different metal compounds so as to obtain a lower eutectic point. An example of such a mixture is an equimolar mixture of $Li_2CO_3$ (m.p. 618° C.), $Na_2CO_3$ (m.p. 851° C.) and $K_2CO_3$ (m.p. 891° C.) having the eutectic point of 385° C. A part of these compounds may be sulfides or sulfites.

The mechanism of the prevention of deposition of carbon and tar-like materials in the cracking apparatus by a mist of molten salt is not clearly understood. Although it is not desired to limit the invention to any particular theory, it is believed that most of the particles of the molten salt are so fine that the resulting carbon is very fine and porous and readily subject to water gas reaction with the diluting steam introduced into the cracking apparatus to convert the carbon to a gas. Additionally, it appears that the tar-like materials attaching to the wall of the apparatus are washed away by the molten salt mist which collides against the wall, and thereby inhibit the formation of block of deposited carbon.

Figure 1:
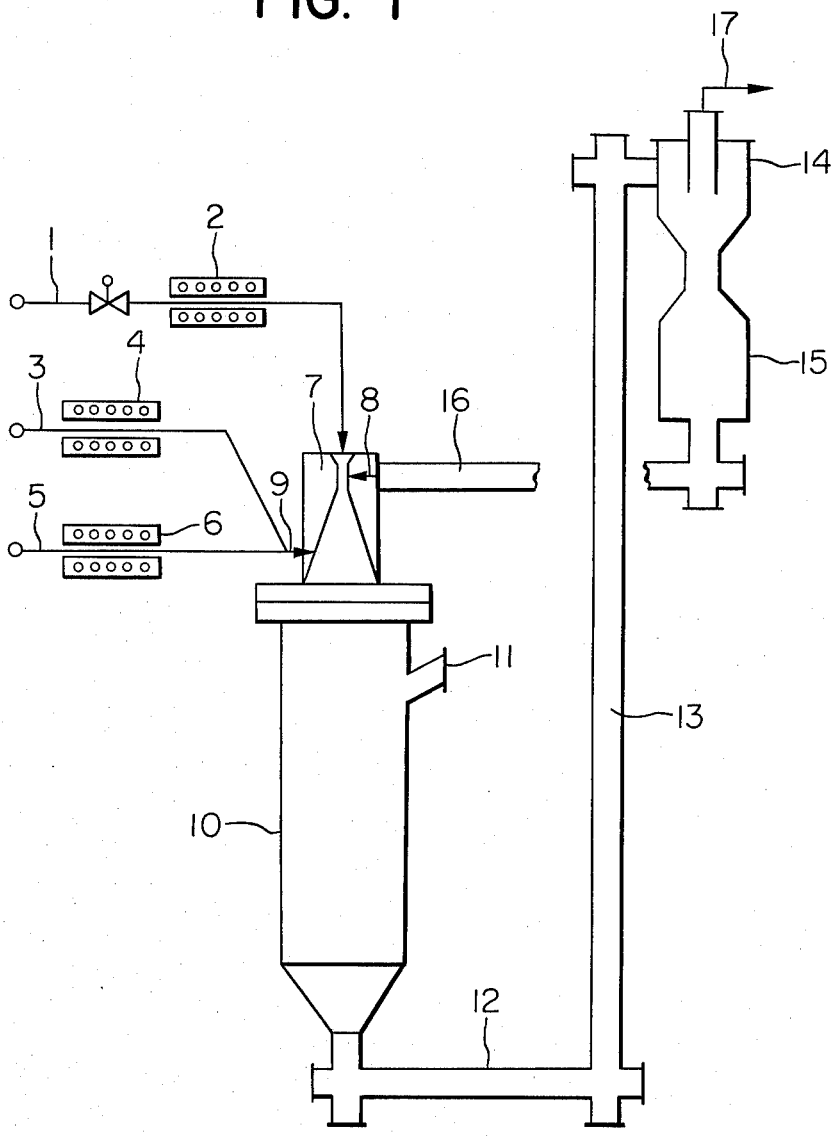
FIGS. 1, 2 and 3 show diagrammatically various forms of apparatus which may be used for carrying out the present invention.

Average particle size of the molten salt in the mist is usually not larger than 300 microns, preferably not larger than 100 microns. The molten salt mist may be produced by using a venturi nozzle as illustrated in FIG. 1. It is not easy to measure average particle size of molten salt mist in a practical apparatus, but the average particle size can be calculated by the equation of Nukiyama and Tanasawa (cf. Perry's Chemical Engineer's Handbook, 4th Ed., 1963, Chapter 18, page 68). When there is used a nozzle with a shape which is not suitable for directly applying the equation of Nukiyama and Tanasawa, a material easy for handling such as a water-air system is used and actual particle size of the water-air system is measured to thereby obtain a correction coefficient for the equation which can be used to calculate the average particle size of an actual molten salt mist.

Other methods for producing the mist include the use of a pressure nozzle such as single hole nozzle, collision spray valve, spiral spray valve, and the like; the use of a rotation method such as rotating disk, rotating pan, rotating spray and the like; the use of gas-atomizing spray such as air or gas-atomizing nozzle and the like; or by vibration.

Further, the mist may be obtained by dissolving or suspending the salt in the crude high-boiling oil or in the water used as a diluting vapor and supplying the resulting solution or suspension to the cracking apparatus.

The structure or shape of the heat decomposition reactor is optional as long as the molten salt mist can be uniformly dispersed in the reactor and can collide with the complete wall area to renew the surface of the wall.

Examples of reactors used for carrying out the present invention include all those typical reactors usually used for cracking hydrocarbons such as tubular reaction furnaces utilizing external heating, column reaction furnaces utilizing inner heating, tubular reaction furnaces utilizing inner heating and the like.

Any of a variety of known quenching devices may be used. The preferred types are multitubular heat exchangers and scrubber columns used for circulating the molten salt.

The ratio of molten salt to hydrocarbon, by weight is from 0.01:1 to 10:1. There is no particular process advantage in exceeding this limit. Moreover, excessive heat is necessary to maintain the salt in a molten state. At ratios appreciably below this ratio the advantages of the invention are not realized.

For the purpose of effecting the water gas reaction in the cracking reaction, steam is normally present in the reaction system. The amount of steam is not critical. It is not economical to use in a large amount, but where the amount is too small, the water gas reaction does not occur to a sufficient extent. In general, the weight ratio of steam to the heavy liquid hydrocarbon is 0.5–5.0, preferably 0.5–2.0. It is also possible to oxidize the formed carbon using carbon dioxide, and thereby to remove the carbon.

According to the present invention, the molten salt is not essentially used as a heat transfer medium so that a quantity of heat should be supplied for the decomposition reaction. It is preferable for supplying heat to introduce directly a superheated steam and/or a combustion gas into the reactor. Such heat medium may be used for forming a mist of the molten salt.

Superheated steam may be produced by blowing the steam into a heat accumulating furnace, and a high temperature combustion gas may be produced by burning, in a burner disposed before the venturi, a part of the crude oil or by-product gas or oil produced by decomposition of the crude oil, and the resulting superheated steam or the high temperature combustion gas is introduced into the venturi. As the combustion gas, there may be used a partial combustion gas. In particular, where high-boiling oil by-products of high sulfur content are produced as the result of cracking and their appropriate use is not found, it is an effective use of the present invention to burn partially the high-boiling oil by-products for gasification and simultaneously utilize the heat energy of the partially burned gas for decomposition of crude oils. According to the above-mentioned procedures, less valuable high-boiling oils of high sulfur content as well as other petrochemical raw materials such ethylene, propylene and the like can be converted to useful hydrogen and combustion gases.

The heat decomposition reaction is effected usually at an inlet temperature of from about 400° C. to 900° C. and an outlet temperature of from about 600° C.–900° C. for 0.001–2 sec., preferably about 0.005–1 sec., and most preferably 0.01 to 0.3 seconds. The quenching temperature is usually 400°–600° C. where a mixture of $Li_2CO_3$—$Na_2CO_3$—$K_2CO_3$ is used as a molten salt.

Now referring to FIG. 1, steam is introduced through a pipe 1 fitted with a control valve, heated by a heater 2 to form a superheated steam and introduced into a venturi nozzle 7 as a superheated steam.

The superheated steam becomes a high speed stream in venturi nozzle 7, and a molten salt is introduced into the high speed stream through a small hole 8 to form a mist.

A crude oil passes through a pipe 3, is heated by a heater 4 and is introduced into a raw material feeding nozzle 9 arranged near the end of the venturi nozzle, and a diluting steam heated by a heater 6 is introduced into the nozzle 9 through a pipe 5. The crude oil is atomized and fed to the end portion of the venturi nozzle. The crude oil is then mixed with the superheated steam containing a mist of the molten salt and introduced into a heat decomposition reactor 10 where the heat decomposition reaction proceeds rapidly. The state of dispersion of the mist in the reactor 10 can be observed through a watching glass 11. The cracked gas produced by a heat decomposition reactor 10 passes through a transfer line 12 and is introduced into a quenching pipe 13 to suppress side reactions of the cracked gas. The temperature in quenching pipe 13 is kept at a temperature not lower than the melting point of the molten salt so as to prevent solidification of the molten salt in the quenching pipe.

The cracked gas cooled by quenching pipe 13 is introduced into a mist separator 14 having a cyclone structure and the molten salt is separated, stored in a reservoir 15 and then circulated again to venturi nozzle 7 through a pipe 16 and a small hole 8.

The separated molten salt may be sent to the mist producing means by various methods such as utilizing a pressure difference, a pump, a steam lift and the like. The cracked gas separated from the molten salt at a mist separator 14 may be sent to the next step through a pipe 17 and separated and purified in any convenient manner.

It will be appreciated by those skilled in the art that the oils which comprise the starting materials for the process of this invention vary appreciably in their chemical and physical properties. Some may be more viscous than others, some may have a high sulfur content, still others may have a high carbon residue. The process of this invention is applicable to all of them. As would be expected however, there will be preferred operating conditions for each of the various starting materials. These preferred conditions which are easily found within the above described operating parameters permits the optimum benefits of the invention for each class of starting material.

For many starting materials the following parameters are most useful.

Molten salt:hydrocarbon - - - 0.01:1–1:1
Steam:hydrocarbon - - - 0.05:1–5:1
Inlet temperature - - - 400° C.–900° C.
Outlet temperature - - - 600° C.–900° C.
Reaction time - - - 0.001–1 second
Particle size of mist - - - >300 microns As the carbon residue (Conradson carbon) in the starting material increases, and the inlet temperature approaches 450° C. or lower, it has been observed that the mixture of molten salt and starting material tends to become more viscous, and the reaction cannot continue for an extended period of time without the hydrocarbon inlet becoming clogged.

This problem can be cured in either of two ways. One is to increase the inlet temperature. From a commercial viewpoint this is not usually desirable because it increases the demand for steam and other heat values. Another, and preferred procedure is to increase the molten salt to hydrocarbon ratio while maintaining the weight ratio of carbon residue to molten salt below 0.03:1. This allows the realization of the principal advantages of the invention without utilization of excess and expensive heat energy. The salt, the major proportion of which is in the form of a mist can still be recirculated. The carbon which forms is still in small particles and readily susceptible to the water gas reaction.

Thus for high carbon residue hydrocarbons the preferred operating parameters are the same as described above except that the weight ratio of molten salt to hydrocarbon is increased to a value of from 1:1 to 10:1 and the amounts of inlet materials are adjusted so that the weight ratio of carbon residue as measured by the Conradson method to molten salt is up to 0.03:1, preferably from 0.005:1 to 0.020:1. The reaction time may also be increased to 2 seconds.

It has been found best to control the operating parameters so that the weight ratio of carbon to molten salt at the outlet is not more than 0.002:1, preferably not more than 0.001:1. This decreases a foaming tendency in the reaction products which may interfere with the smooth separation of the reaction components.

The following non-limiting examples are given by way of illustration only.

EXAMPLE 1

Arabian Light crude was cracked to produce high-boiling olefins. Referring to FIG. 1, steam of 3 Kg./cm$^2$ was introduced at a rate of 8 Kg./hr. through a pipe 1 and converted to a superheated steam of 850° C. by a heater 2. The resulting superheated steam was introduced into a venturi tube 7 having a throat diameter of 9.5 mm. and the venturi tube was kept at 800° C. by an electric heater. The venturi throat portion was provided with a small lateral bore having a diameter of 2 mm. Through the small lateral bore was supplied a molten salt comprising an equimolar mixture of $Li_2CO_3$-$K_2CO_3$-$Na_2CO_3$ kept at 600° C. at a rate of 0.5 Kg./hr. to produce a mist of molten salt by high speed flow of 160 m./sec. at the throat portion.

Average size of the mist particle was 50 microns according to the equation of Nukiyama and Tanasawa. Arabian Light crude introduced at a rate of 4.5 Kg./hr. through a pipe 3 and heated to 350° C. by a heater 4 and steam introduced through a pipe 5 and heated to 500° C. by a heater 6 were mixed and then ejected into the molten salt mist stream through a raw material feeding nozzle 9 of 2 mm. in diameter.

A heat decomposition reactor 10, 90 mm. in diameter and 1 m. in length was heated from outside by an electric heater and the heating was controlled in such a manner that the temperature of the cracked gas at the exit of the heat decomposition reactor was 800° C. The resulting cracked gas produced in the heat decomposition reactor 10 was introduced into a quenching heat exchanger 13, 25 mm. in inner diameter and 2400 mm. in length through a transfer line 25 mm. in inner diameter and 600 mm. in length, cooled in the quenching heat exchanger to result in an exit gas temperature of 500° C. It was then subjected to separation of the molten salt mist in a mist separator 14 of a cyclone type. The resulting cracked gas was then cooled with a circulating cracked oil and a cooling water, measured by a flow meter and analyzed by chromatography.

The molten salt was stored in a reservoir 15 in an amount of 15 Kg. kept at 500° C. so as to prevent the solidification.

The results are as shown below.

| | | |
|---|---|---|
| (1) | Crude oil | Arabian Light crude |
| | Specific gravity | 0.852 |
| | Sulfur contents | 1.6% by weight |
| | Conradson carbon residue (measured according to ASTM D-189-52) | 3.1% by weight |
| (2) | Operation conditions | |
| | Crude oil feed | 4.5 Kg./hr. |
| | Total steam feed | 9.0 Kg./hr. |
| | Amount of the recirculating molten salt | 0.5 Kg./hr. |
| | Inlet temperature | 800° C. |
| | Pressure in the heat decomposition reactor | 50 mmHg gauge |
| | Residence time | 0.5 sec. |
| | Quenching temperature | 500° C. |
| | Pressure | 45 mmHg gause |
| | Residence time | 0.13 sec. |

Yield and Composition of Cracked Gas

| | % by weight |
|---|---|
| $H_2$ | 3.01 |
| $CH_4$ | 11.97 |
| $C_2H_4$ | 23.81 |
| $C_2H_6$ | 2.31 |
| $C_3H_6$ | 9.70 |
| $C_3H_8$ | 0.0 |
| $C_4$ | 2.86 |
| $C_5^+$ | 27.13 |
| CO | 1.32 |
| $CO_2$ | 18.81 |
| TOTAL | 100.92 |
| Oily matter | 15.29 |

Under the above mentioned conditions the operation was continued for 624 hours. No difficulties such as rise of pressure were observed during the operation. After the operation was stopped, the apparatus was dismounted and inspected. No deposition of carbon and tar-like materials was found in the decomposition reactor, transfer line, quenching heat exchanger, and mist separator at all. Carbon suspended in the molten salt was as fine as less than 1 micron in size and the concentration was 100 ppm. When the inlet temperature was decreased to 500° C. the inlet became clogged after 2 hours.

COMPARATIVE EXAMPLE

The procedure of Example 1 was repeated except that the small lateral bore 8 was checked. After 4 hours, the pressure of the quenching heat exchanger increased markedly and after 5 hours, the operation became impossible. Upon inspection of the inside of the apparatus, it was then found that fine carbon had deposited in the heat decomposition reactor and carbon of a dense structure which seemed to be the carbonized tar-like materials had deposited in the quenching heat exchanger. The total amount of deposited carbon amounted to 2.3% by weight based on the supplied Arabian Light crude.

EXAMPLE 2

Figure 2:
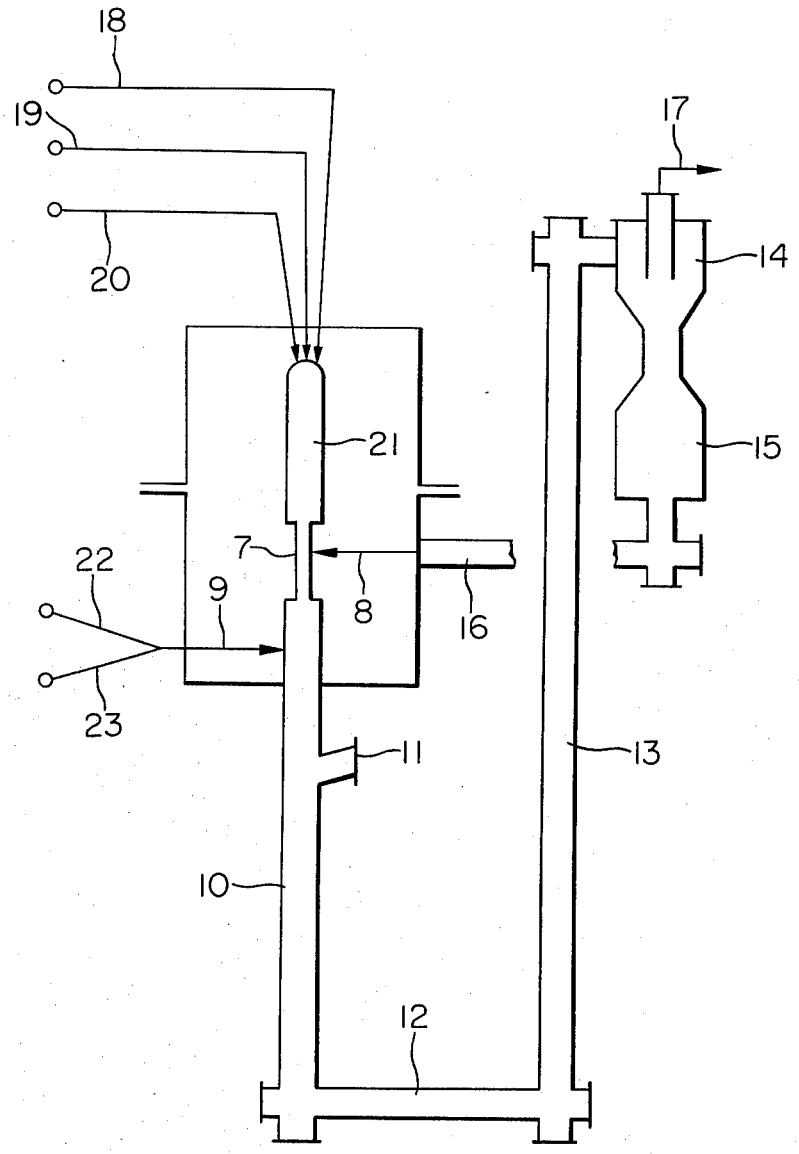

Referring to FIG. 2, Arabian Light crude was cracked to produce low-boiling olefins by a high temperature medium.

To a combustion chamber 21 were introduced propane at a rate of 1 Kg./hr. through a pipe 18, oxygen at a rate of 3.64 Kg./hr. through a pipe 19, and steam at a rate of 8 Kg./hr. through a pipe 20, and there was produced a high temperature gas at 2000° C. This high temperature gas then passed through a venturi pipe 7 of 11.5 mm. in diameter, and a molten salt comprising an equimolar mixture of $Li_2CO_3$-$K_2CO_3$-$Na_2CO_3$ kept at 600° C. was introduced into the venturi pipe through a small lateral bore of 2 mm. in diameter at a rate of 0.5 Kg./hr., and the molten salt thus introduced was formed into mist by the high speed stream of 340 m./sec. Then Arabian Light crude introduced through a pipe 22 at a rate of 4.5 Kg./hr. and heated to 350° C. by a heater and a stream introduced through a pipe 23 and heated to 500° C. by a heater were preliminarily mixed and then ejected into the molten salt mist through a raw material feeding nozzle 9 of 2 mm. in diameter.

A heat decomposition reactor 10, 30 mm. in diameter and 1 m. in length was externaly heated by an electric heater and the temperature of the cracked gas at the exit of the heat decomposition reactor 10 was adjusted to 800° C. by controlling the heat loss.

The resulting cracked gas from heat decomposition reactor 10 passed through a transfer line 12 of 30 mm. in inner diameter and 600 mm. in length which pipe wall temperature was kept at 750° C., and was cooled in a quenching heat exchanger 13 of 25 mm. in inner diameter and 3 m. in length in such a way that the exit temperature was 500° C. Then the cracked gas together with the molten salt mist entered a mist separator 14 of a cyclone type and the molten salt mist was separated and collected in a reservoir 15. The cracked gas thus separated was led through a pipe 17. The cracked gas was cooled with a circulating cracked oil and a cooling water, measured by a flow meter and analyzed by chromatography.

| | | |
|---|---|---|
| (1) | Crude oil | Arabiran Light crude |
| (2) | Operation conditions | |
| | Inlet temperature | 800° C. |
| | Pressure in the heat decomposition reactor | 80 mmHg gauge |
| | Crude oil feed | 4.5 Kg./hr. |
| | Total steam feed | 9.0 Kg./hr. |
| | Amount of the recirculating molten salt | 0.5 Kg./hr. |
| | Residence time in the heat decomposition reactor | 0.1 sec. |
| | Temperature at the quenching heat exchanger | 500° C. |

-continued

| | |
|---|---|
| Pressure | 75 mmHg gauge |
| Residence time at the quenching heat exchanger | 0.2 sec. |

(3) Yield and Composition of Cracked Gas

| | % by weight |
|---|---|
| $H_2$ | 2.61 |
| $CH_4$ | 7.29 |
| $C_2H_2$ | 1.38 |
| $C_2H_4$ | 19.27 |
| $C_2H_6$ | 1.43 |
| $C_3H_6$ | 10.46 |
| $C_3H_8$ | 0.00 |
| $C_4$ | 5.59 |
| $C_5+$ | 24.74 |
| CO | 0.58 |
| $CO_2$ | 13.70 |
| TOTAL | 87.05 |
| Oily matter | 24.55 |

Under the above mentioned conditions the operation was continued for 220 hours. No difficulties such as rise of pressure were observed during the operation, and after the operation was stopped, the apparatus was dismounted and inspected. No deposition of carbon tar-like materials was found in the decomposition reactor, transfer line, quenching heat exchanger, or mist separator. Carbon suspended in the molten salt was as fine as less than 1 micron in size and the concentration was 100 ppm.

Alternatively, when crude oil fed through a pipe 22 and steam fed through a pipe 23 were introduced into the venturi throat portion, a similar result was obtained.

EXAMPLES 3-5 and COMPARATIVE EXAMPLES 3-5

Figure 3:
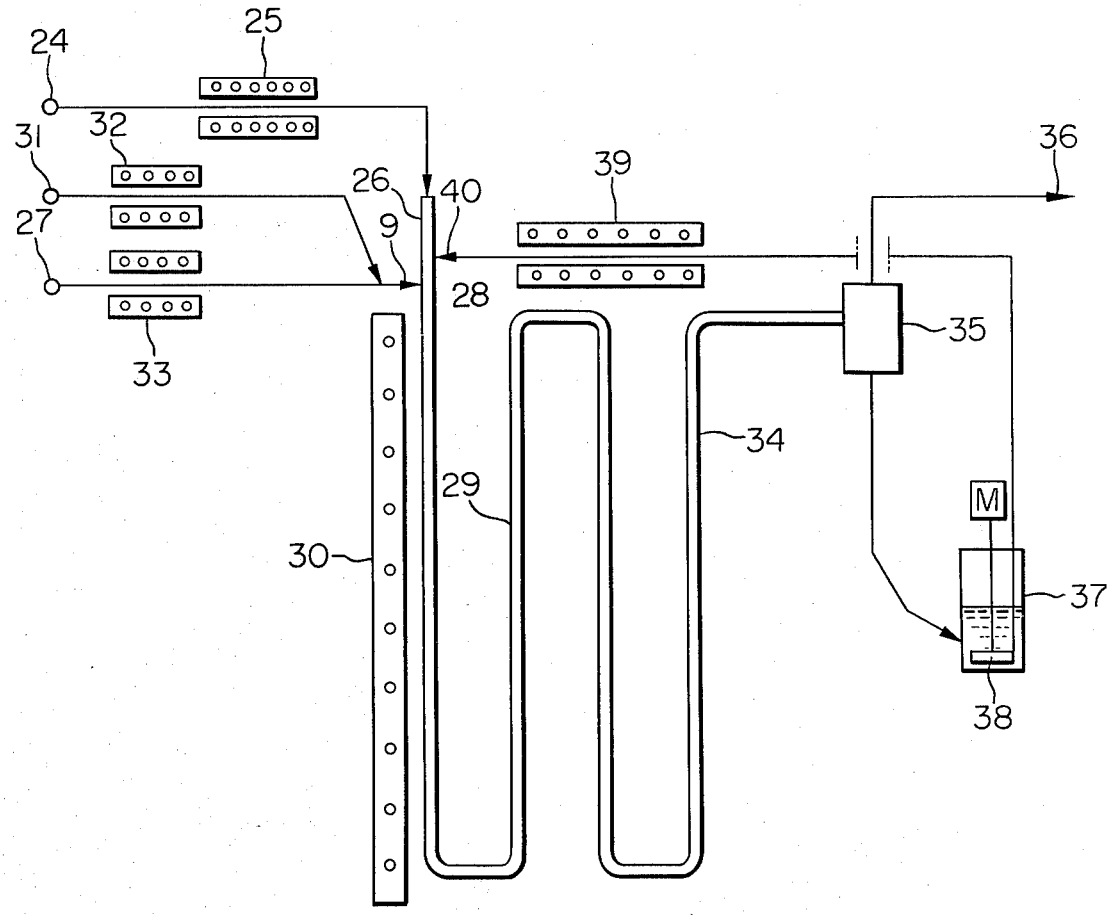

Referring to FIG. 3, steam 24 superheated to 750° C. by a heater 25 was introduced into a venturi throat 26. The venturi throat portion was provided with a small lateral bore having a diameter of 2 mm. Through the small lateral bore 40 was supplied an equimolar mixture of $Na_2CO_3$-$K_2CO_3$-$Li_2CO_3$ kept at 750° C. as a molten salt to produce a mist of the molten salt.

A mixture of Minas crude oil 3 (Conradson carbon residue: 2.5% by weight) and steam 27 (10% of total steam feed was fed at 300° C. to an upper portion 28 of a reactor pipe 29 (21.7 mm. of outer diameter and 14.3 mm. of inner diameter and 11 m. in length) of an external heating type disposed below the venturi throat and heated by a heater 30 to effect cracking.

The Minas crude oil 31 and steam were heated by heaters 32 and 33, respectively. After cracking, the reaction mixture was quenched at a quenching portion 34 to 500° C. and then the molten salt and the cracked gas were separated at separator 35. The cracked gas 36 thus separated was sent to a purification step and the molten salt thus separated was collected in a drum 37, transferred by a pump 38 driven by a motor M and heated by a heater 39 for reuse.

The reaction conditions and reaction results are shown in Table 1 below.

TABLE 1

| | | Example 3 | Example 4 | Example 5 | Comparative Example 3 | Comparative Example 4 | Comparative Example 5 |
|---|---|---|---|---|---|---|---|
| Crude oil feed | Kg./hr. | 4.0 | 4.0 | 4.0 | 4.0 | 4.0 | 4.0 |
| Amount of the fed molten salt | Kg./hr. | 12.0 | 20.0 | 40.0 | 1.2 | 12.0 | 12.0 |
| Carbon residue in crude oil | molten salt | 0.0083 | 0.005 | 0.0025 | 0.083 | 0.0083 | 0.0083 |
| Steam feed | Kg./hr. | 4.0 | 4.0 | 4.0 | 4.0 | 4.0 | 1.6 |
| Inlet temperature | °C. | 600 | 700 | 760 | 500 | 600 | 550 |
| Carbon in molten salt after reaction | molten salt | 0.0001 | 0.0002 | 0.0002 | 0.001 | 0.004 | 0.003 |
| Yields of reaction products (parts by weight per 100 parts by weight of the crude oil) | $H_2$ | 2.2 | 2.0 | 1.8 | 2.1 | 1.4 | 1.6 |
| | $CH_4$ | 12.2 | 11.0 | 9.9 | 12.1 | 8.0 | 15.2 |
| | $C_2H_2$ | 0.3 | 0.3 | 0.3 | 0.3 | 0.2 | 0.3 |
| | $C_2H_4$ | 26.0 | 25.7 | 24.0 | 25.9 | 20.0 | 20.0 |
| | $C_2H_6$ | 2.0 | 2.4 | 2.1 | 2.2 | 1.5 | 2.2 |
| | $C_3H_6$ | 13.2 | 15.0 | 14.3 | 13.6 | 11.0 | 9.5 |
| | $C_3H_8$ | 0.2 | 0.2 | 0.2 | 0.2 | 0.2 | 0.2 |
| | $C_4$ | 7.0 | 9.2 | 9.2 | 7.0 | 6.0 | 5.0 |
| | $C_5+$ | 16.0 | 14.8 | 11.5 | 14.5 | 12.0 | 12.4 |
| | CO | 1.1 | 0.8 | 0.7 | 1.0 | 0.4 | 0.5 |
| | $CO_2$ | 13.5 | 11.5 | 10.5 | 12.4 | 5.0 | 6.2 |
| Note | | During 300 hours continuous operation, no clogging of the reactor pipe occured. The molten salt was repeatedly used without regeneration, and these results continue for more than 1000 hours. | The same as Example 3 | The same as Example 3 | Clogged in 4 hours after starting the reaction. | Foaming of the molten salt occurred and reuse was not possible. Regeneration was necessary. | The same as Comparative Example 4 |

What we claim is:

1. A process which comprises cracking hydrocarbons in a cracking reaction zone in the presence of a mist of molten salt containing salt particles with an average particle size up to 300 microns, said salts being selected from the group consisting of basic compounds of alkali metals, alkaline earth metals and mixtures thereof, the weight ratio of molten salt to hydrocarbon being from 0.01:1 to 10:1, introducing the resulting cracked gas containing mist of molten salt into a means for quenching at a temperature not lower than the melting point of the molten salt, and separating the cracked gas and the molten salt from each other.

2. A process as in claim 1 wherein the weight ratio is from 0.01:1 to 1:1.

3. A process as in claim 1 wherein the weight ratio is from 1:1 to 10:1.

4. A process as in claim 2 carried out in the presence of steam.

5. A process as in claim 3 carried out in the presence of steam.

6. A process as in claim 1 in which the average particle size of the molten salt in the mist is up to 100 microns.

7. A process as in claim 1 in which the molten salt is an equimolar mixture of lithium carbonate, sodium carbonate and potassium carbonate.

* * * * *